US005199820A

United States Patent [19]

Nicklo

[11] Patent Number: 5,199,820

[45] Date of Patent: Apr. 6, 1993

[54] ATTITUDE ADJUSTING APPARATUS FOR SCUBA DIVERS

[76] Inventor: Joseph J. Nicklo, 11110 Vanderford, Houston, Tex. 77099

[21] Appl. No.: 688,307

[22] Filed: Apr. 22, 1991

[51] Int. Cl.[5] ..... B63C 11/02

[52] U.S. Cl. ..... 405/186; 405/185; 114/315; 114/332

[58] Field of Search ..... 405/186, 185, 187; 114/315, 330, 331, 332; 441/114, 117, 119

[56] References Cited

U.S. PATENT DOCUMENTS

| | | | |
|---|---|---|---|
| 2,968,159 | 1/1961 | Edmund | 405/186 |
| 3,269,129 | 8/1966 | Zambrano | 405/186 |
| 3,342,036 | 9/1967 | Gruget | 405/186 |
| 3,374,636 | 3/1968 | Mason | 405/186 |
| 3,379,023 | 4/1968 | Crose | 405/186 |
| 3,964,266 | 6/1976 | Bartlett | 405/186 |
| 3,967,459 | 7/1976 | Denis | 405/186 |
| 4,812,083 | 3/1989 | Mosier | 405/186 |
| 4,848,965 | 7/1989 | Peterson | 405/186 |
| 5,074,714 | 12/1991 | Franco | 405/186 |

*Primary Examiner*—Randolph A. Reese
*Assistant Examiner*—J. Russell McBee
*Attorney, Agent, or Firm*—Kenneth A. Roddy

[57] ABSTRACT

An attitude adjusting apparatus for use by scuba divers automatically varies the position of ballast relative to the center of buoyancy as the attitude of their body underwater changes. An elongate hollow weight tube enclosed at one end has a removable closure at the opposite end and contains a quantity of small metal balls or shot. The weight tube is carried in close proximity to the torso of the diver in a position with its longitudinal axis generally parallel to the longitudinal axis of the torso of the diver. The free-moving balls or shot are movably disposed within the interior of the weight tube and are movably distributed at varying locations within the weight tube between a forward lowermost position as the diver assumes a descending head-down position and a rearward lowermost position as the diver assumes an ascending head-up position, and will be distributed along the length of the weight tube as the diver assumes a horizontal position. One or more weight tubes are releasably connected to a diver's air tank or back board by a quick release snap-fit coupling having a resilient jettisoning mechanism which allows the weight tubes to be quickly disconnected and forcefully propelled away from the diver in the event of an emergency. The weight tubes may also be releasably carried in pockets on a buoyancy compensator vest worn by the diver.

21 Claims, 4 Drawing Sheets 35
17
36
36
38
38
37
37
31
34
32A
11
B
12
33
31
30
32B
32
I
26
14
25
24
21
28
29
16
27
19
28
20
29
15
13
22
10
18
W
23

APTITUDE ADJUSTING APPARATUS FOR SCUBA DIVERS

BACKGROUND OF THE INVENTION

1. Field of the Invention

This invention relates generally to diving equipment, and more particularly to an attitude adjusting device for scuba divers which utilizes free-moving weights to automatically vary the position of the ballast as the attitude of the diver changes to maintain a more efficient swimming position.

2. Brief Description of the Prior Art

In the following description the terms, as related to scuba diving, should be understood to have the following meanings. Buoyancy means the tendency to float or rise in the water. Ballast is meant to mean weights or heavy material carried by a diver to control stability and vertical distance in the water. Attitude is meant to mean the inclination of the diver's body relative to horizontal. Trim is meant to mean the adjustment of the diver's physical position while in the water by arranging the ballast. An ideal trim position would be perfectly horizontal.

Ballast devices and buoyancy compensator devices are known in the art. Buoyancy compensator devices or "BC's" are a relatively recent development and are vest-like devices worn on the torso of the diver and have a bladder which may be filled with air to control the buoyancy of the diver. In the event of an emergency, the ballast can be jettisoned and the B.C. quickly inflated to allow the diver to rise to the surface. Buoyancy compensator devices place the center of buoyancy above the diver's mid section.

Most buoyancy compensator devices have a cummerbund type belt having a quick release buckle which fastens in the front of the diver's waist. Most weight belts are also fastened by a quick release buckle in the front of the diver's waist. Often, the diver will have trouble quickly locating the proper buckle to release in an emergency and could accidentally release the wrong device.

Conventional weight belts are undesirable for many reasons. Unsecured weights can interfere with the operation of the quick release buckle. Weight belts are difficult to tighten snugly and can rotate on the wearer and, as the weight shifts, the diver will list to one side. Weight belts are also uncomfortable due to the pressure placed on the hips by the weights. In some cases, especially with women divers, bruises may appear in the hip area.

Buoyancy control and proper weighting are among the most important skills of scuba diving. A proper distribution of weight will allow the diver to maintain a perfectly horizontal, face-down position underwater while motionless. The incorrect amount of weight and wrong placement of the weight contribute to an undesirable, uncomfortable, and inefficient swimming attitude in the water. Overweighting forces a diver to have excessive air in his or her buoyancy compensator to achieve neutral buoyancy and raises the diver from the proper horizontal position. The more air required in the buoyancy compensator, the more difficult it is to control buoyancy during changes in depth and during descents and ascents. Because of the air in the lungs and the buoyancy compensator and the placement of the weight belt on the hip, divers tend to assume a somewhat head-up attitude in the water.

The head-up position increases the cross-sectional area, resulting in increased drag, which requires more energy for swimming. The more energy required, the more air consumed, and consequently less time beneath the surface.

Most weight devices including weight belts position the weight or ballast near the mid-section of the diver. This weight remains stationary throughout the dive period. In an attempt to achieve the ideal horizontal position or attitude, some divers will place a few pounds of weight near the top of their air tank. Although a diver will change attitudes many times during the diving period, the weights remain fixed for one attitude or position.

The most efficient trim adjustment would be to provide more weight in the head and shoulder area near the top of the air tank for a head-down attitude and to provide more weight in the mid-section area for a head-up attitude. Attitudes between these two extremes would require positioning of the weight along the longitudinal plane of the diver's body at certain locations to achieve the desired attitude.

There are several patents which disclose various weight systems and devices for controlling the buoyancy of a scuba diver.

Edmund, U.S. Pat. No. 2,968,159 discloses a combined air tank and weight carrier with a pair of parallel, laterally spaced tubes into which a plurality of short cylindrical metal weights are received in stacked relation. The short cylindrical weights allow the diver to more easily carry the total amount of weight necessary to overcome buoyancy. A pin at the bottom of the tubes allow the weights to be quickly dumped from the bottom of the tubes in an emergency so that the diver will rise immediately to the surface.

Crose, U.S. Pat. No. 3,379,023 discloses a pair of balance tanks which fit onto the divers air tank and are adapted to be filled and depleted of water by displacing it with air. The device controls buoyancy by adding or subtracting weight.

Denis, U.S. Pat. No. 3,967,459 discloses an independent weight system which is attached to a divers air tank. The system includes a pair of tubes which receive short cylindrical weights. A pin at the bottom of the tubes allow the weights to be quickly released. The weight carrying tubes are attached to the air tank such that the center of gravity of the underwater breathing equipment and attached weight system is below the overall center of buoyancy. By placing the center of gravity below the center of buoyancy, the diver will tend to assume a vertical head-up position, whereas the present invention utilizes the center of buoyancy as a fulcrum point for the movement of the weights in the weight tubes to assume a proper trim position relative to a horizontal axis.

Zambrano, U.S. Pat. No. 3,269,129 discloses a back pack for a diver's air tank including a pair of tubes which attach to the diver's air tank and into which a plurality of short cylindrical metal weights are received in stacked relation. A pin at the bottom of the tubes allows the weights to be quickly dumped from the bottom of the tubes in an emergency so that the diver will rise immediately to the surface. This device is an improvement over the Edmund device in that a compression spring disposed in the tubes above the weights keep them at their lowermost position and will forcefully eject the weights when the pin is pulled and vent holes above the weights facilitates jettisoning of the weights.

Although Zambrano was designed prior to the development of buoyancy compensator devices, he recognized the problem of maintaining a proper attitude in the water and suggests that the spring may be removed or pinned in the compressed condition allowing the weights to slide in the tubes from one end to the other as the diver tilts his body upward or downward. However, the solid weight cylinders sliding from one end to the other would not allow the ballast to be distributed in a manner to obtain a horizontal swimming position, and additional energy would be expended in attempting to overcome the upward or downward diving angle to maintain a horizontal swimming position.

Bartlett, U.S. Pat. No. 3,964,266 discloses a back pack for divers which is filled or depleted with air to achieve neutral buoyancy. A weight at the bottom of the pack is quickly released by a spring biased pin.

Shieh, U.S. Pat. No. 4,498,878 discloses a back pack for divers which merely carries a variety of life saving equipment.

The present invention is distinguished over the prior art in general, and these patents in particular by an attitude adjusting apparatus for use by scuba divers which automatically varies the position of ballast relative to the center of buoyancy as the attitude of their body underwater changes. An elongate hollow weight tube enclosed at one end has a removable closure at the opposite end and contains a quantity of small metal balls or shot. The weight tube is carried in close proximity to the torso of the diver in a position with its longitudinal axis generally parallel to the longitudinal axis of the torso of the diver. The free-moving balls or shot are movably disposed within the interior of the weight tube and are movably distributed at varying locations within the weight tube between a forward lowermost position as the diver assumes a descending head-down position and a rearward lowermost position as the diver assumes an ascending head-up position, and will be distributed along the length of the weight tube as the diver assumes a horizontal position. One or more weight tubes are releasably connected to a diver's air tank or back board by a quick release snap-fit coupling having a resilient jettisoning mechanism which allows the weight tubes to be quickly disconnected and forcefully propelled away from the diver in the event of an emergency. The weight tubes may also be releasably carried in pockets on a buoyancy compensator vest worn by the diver.

SUMMARY OF THE INVENTION

It is therefore an object of the present invention to provide an attitude adjusting apparatus for scuba divers which will automatically vary the position of ballast as attitude of their body underwater changes to achieve the most efficient swimming position in the water.

It is another object of this invention to provide an attitude adjusting apparatus for scuba divers which will reduce the energy and air expended by a diver in attempting to overcome a stationary positioned ballast to change the swimming attitude in the water.

Another object of this invention is to provide an attitude adjusting apparatus for scuba divers which allows ballast to be quickly and easily releasably attached to the diver's air tank or back board and eliminates the need to wear unsafe and uncomfortable weight belts around the diver's midsection.

Another object of this invention is to provide an attitude adjusting apparatus for scuba divers which utilizes free-moving weights capable of being positioned at varying locations relative to the center of buoyancy as the attitude of the diver's body changes.

Another object of this invention is to provide an attitude adjusting apparatus for scuba divers which utilizes relatively small free-moving metal balls or shot weights in a cylindrical member which as the diver assumes a descending head-down position will slowly move to a forward position relative to the center of buoyancy, and as the diver assumes a horizontal position the weights will be positioned along the length of the cylindrical member, and as the diver assumes an ascending head-up position the weights will move to a rearward position relative to the center of buoyancy.

Another object of this invention is to provide an attitude adjusting apparatus for scuba divers which utilizes one or more tubular weight tubes which are releasably connected to the diver's air tank or back board by a quick release mechanism, or carried on the buoyancy compensator whereby the weight can be quickly jettisoned in the event of an emergency.

Another object of this invention is to provide an attitude adjusting apparatus for scuba divers which utilizes one or more tubular weight tubes containing movable weights which have a quick release mechanism at one end which allows the weight to be quickly dumped from the tubes in the event of an emergency.

Another object of this invention is to provide an attitude adjusting apparatus for scuba divers which utilizes one or more tubular weight tubes releasably connected to the diver's air tank or back board device by a spring loaded quick release mechanism which will forcefully propel the weight tubes away from the air tank or back board when released.

Another object of this invention is to provide an attitude adjusting apparatus for scuba divers which utilizes relatively small metal balls or shot in a cylindrical member which is easily handled and transported.

Another object of this invention is to provide an attitude adjusting apparatus for scuba divers which utilizes relatively small metal balls or shot in a cylindrical member which allows the total weight of the ballast to be selectively increased or decreased to more precisely correspond to the particular buoyancy factor and diving gear worn by the diver.

A further object of this invention is to provide a back board device worn on the torso of a scuba diver which has movable ballast releasably attached thereto which will vary in position as the attitude of the diver's body underwater changes.

A still further object of this invention is to provide an attitude adjusting apparatus for scuba divers which is simple in construction, economical to manufacture, and rugged and reliable in use.

Other objects of the invention will become apparent from time to time throughout the specification and claims as hereinafter related.

The above noted objects and other objects of the invention are accomplished by an attitude adjusting apparatus for use by scuba divers which automatically varies the position of ballast relative to the center of buoyancy as the attitude of their body underwater changes. An elongate hollow weight tube enclosed at one end has a removable closure at the opposite end and contains a quantity of small metal balls or shot. The weight tube is carried in close proximity to the torso of the diver in a position with its longitudinal axis generally parallel to the longitudinal axis of the torso of the diver. The free-moving balls or shot are movably disposed within the interior of the weight tube and are movably distributed at varying locations within the weight tube between a forward lowermost position as the diver assumes a descending head-down position and a rearward lowermost position as the diver assumes an ascending head-up position, and will be distributed along the length of the weight tube as the diver assumes a horizontal position. One or more weight tubes are releasably connected to a diver's air tank or back board by a quick release snap-fit coupling having a resilient jettisoning mechanism which allows the weight tubes to be quickly disconnected and forcefully propelled away from the diver in the event of an emergency. The weight tubes may also be releasably carried in pockets on a buoyancy compensator vest worn by the diver.

DESCRIPTION OF THE PREFERRED EMBODIMENT

Figure 1:
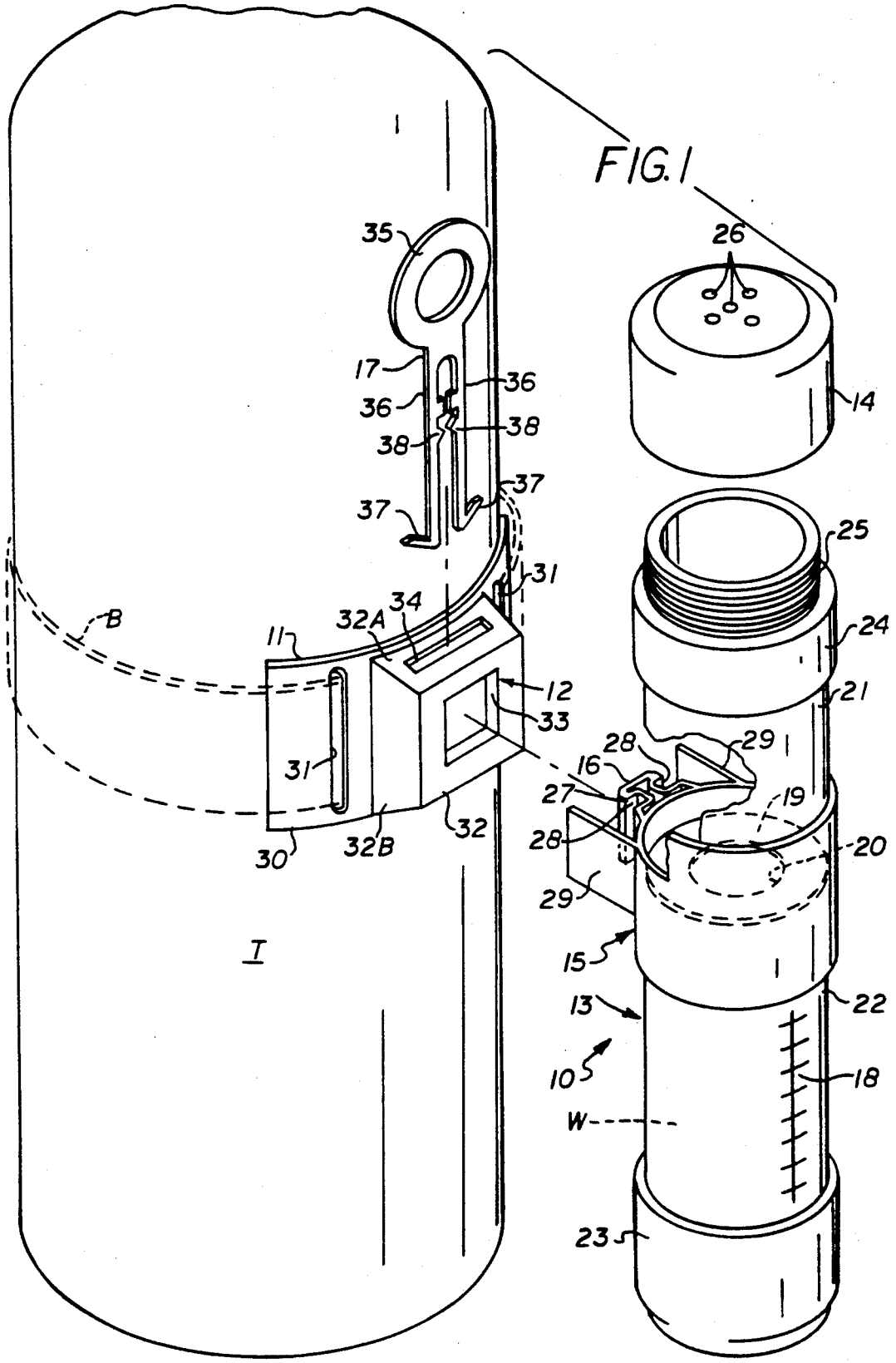
FIG. 1 is an exploded isometric view of an attitude adjusting device in accordance with the present invention shown to be attached to a diver's air tank.

Referring to the drawings by numerals of reference, there is shown in FIG. 1, a preferred attitude adjusting device 10 shown to be attached to a scuba diver's air tank T. One or more mounting brackets having a female receptacle 12 are releasable secured to the circumference of the air tank T by the web belt B used to secure the air tank to a tank support rack, or by a separate belt. The attitude adjusting device 10 is a hollow tubular member or weight tube 13 enclosed at one end and has a removable cap 14 at the opposite end.

A quick release coupling 15 is secured to the weight tube 13 and has a male extension 16 extending laterally outwardly from the circumference of the weight tube intermediate its ends. As described in detail hereinafter, the male extension 16 of the coupling 15 is received in the female receptacle 12 of the mounting bracket 11 and releasably secured therein by a fork pin member 17.

One end of a conventional emergency release strap or cable (not shown) is connected to the ring of the fork pin 17 and its other end is provided with a D-ring which is conveniently disposed on the front of the existing buoyancy compensator device or back board to which the air tank is attached. Although a single weight tube 13 is shown attached to the air tank T, it should be understood that more than one tube may be secured to the air tank in circumferentially spaced relation.

The weight tube 13 carries a predetermined amount of weight or ballast W in the form of small lead balls or shot which move within the weight tube as the attitude of the diver changes. The amount of weight or ballast is determined by the buoyancy factor of the diver and can be adjusted accordingly. Optionally, the side wall of the weight tube 13 may be provided with calibrated markings 18 or indicia along its length which represent the amount of weight corresponding to the volume of lead balls or shot which are placed into the weight tube.

Figure 2:
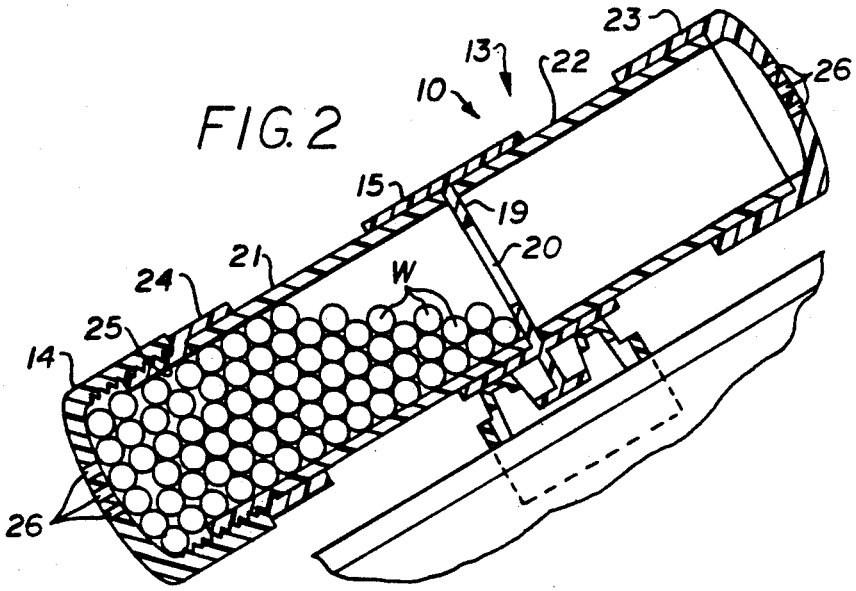
FIG. 2 is a longitudinal cross section through the weight tube shown in a descending position.
Figure 3:
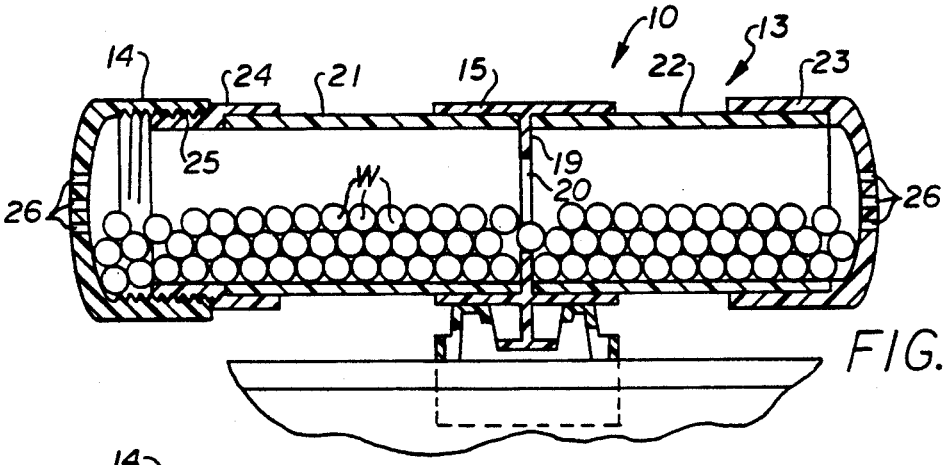
FIG. 3 is a longitudinal cross section through the weight tube shown in a horizontal position.
Figure 4:
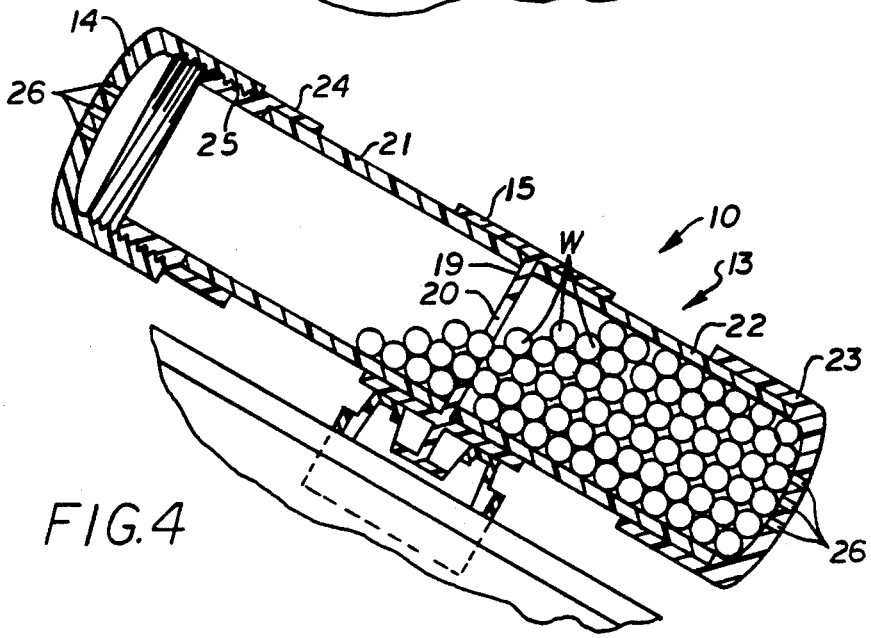
FIG. 4 is a longitudinal cross section through the weight tube shown in an ascending position.

Referring additionally to FIGS. 2, 3, and 4, in a preferred embodiment, the weight tube 13 is constructed of an open-ended tubular coupling 15 having a central baffle plate 19 dividing its interior into an upper portion and lower portion. The baffle plate 19 has a central opening 20 therethrough. An upper section of tubing 21 is secured within the upper portion of the coupling 15 and a lower section of tubing 22 is secured in the lower portion of the coupling. An end cap 23 is secured onto the lower section of tubing 22 to enclose one end of the tubular structure. A threaded adapter 24 is secured on the open end of the upper section of tubing 21 and has exterior threads 25. A threaded cap 14 is threadedly received on the threads 25 and forms a removable closure for the tubular structure. The cap members 14 and 23 are provided with vent holes 26 through their end walls allowing water to circulate through, and drain from, the weight tube 13.

The opening 20 in the baffle plate 19 is configured to allow the lead balls or shot W to pass slowly through the mid-section of the weight tube 13 as the diver changes his attitude in the water. FIG. 2 shows the weight tube 13 in a diver descending (head-down) position with the lead balls or shot W moved into the lowermost front portion of the weight tube. FIG. 3 shows the weight tube 13 in the ideal horizontal swimming attitude with the lead balls or shot W distributed evenly along the entire length of the weight tube. FIG. 4 shows the weight tube 13 in a diver ascending (head-up) position with the lead balls or shot W in the lowermost rear portion of the weight tube. The free moving lead balls or shot W slowly and adjustably reposition the weight or ballast automatically as the attitude of the diver changes, thereby insuring the most streamlined (fish-like) efficient swimming position. Consequently, the diver conserves energy and uses less air, allowing more dive time.

Figure 5:
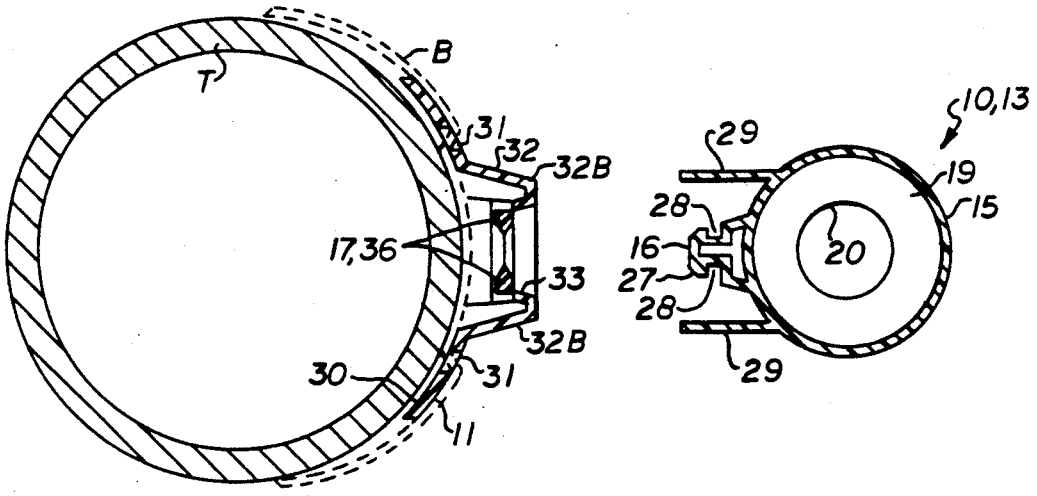
FIG. 5 is a transverse cross section through the coupling members of the attitude adjusting device showing the weight tube disconnected from the diver's air tank.
Figure 6:
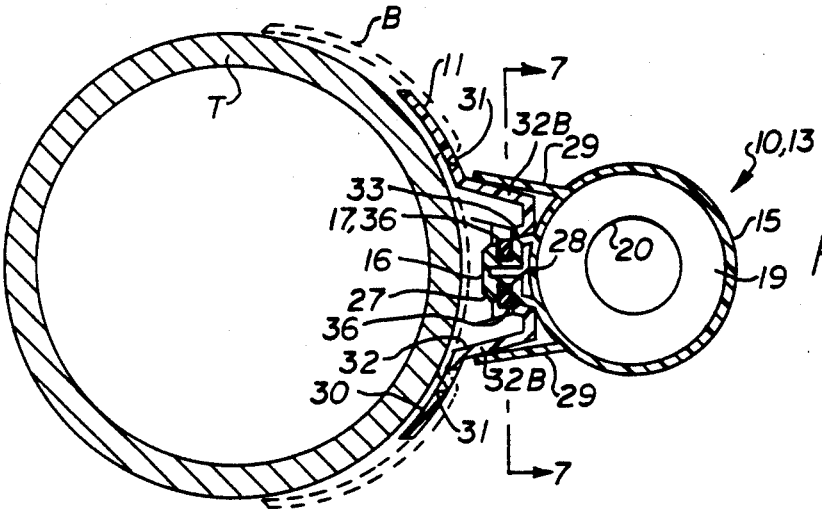
FIG. 6 is a transverse cross section through the coupling members of the attitude adjusting device showing the weight tube connected to the diver's air tank.
Figure 7:
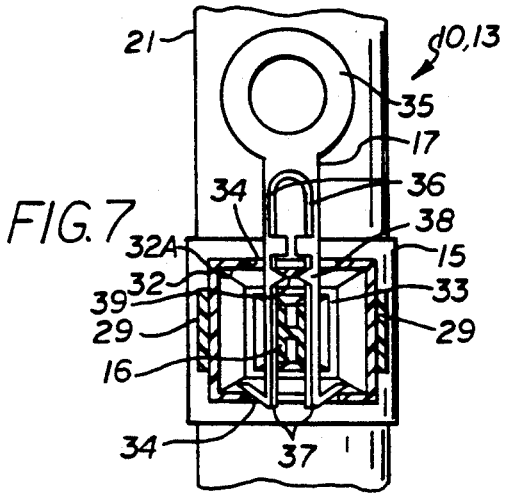
FIG. 7 is a vertical cross section through the coupling members of the attitude adjusting device showing the weight tube connected to the diver's air tank.

As best seen in FIGS. 5, 6, and 7, a generally square tapered male extension portion 16 extends laterally outward from the circumference of the coupling 15 intermediate its ends. The vertical corners on the outer wall of the male extension 16 are tapered 27. A pair of vertical slots 28 are formed along opposite side walls of the extension 16 adjacent the tapered corners 27. A pair of parallel, generally rectangular ejector tabs 28 spaced laterally one to each side of the male extension 16 extend outwardly from the circumference of the coupling 15.

Figure 8:
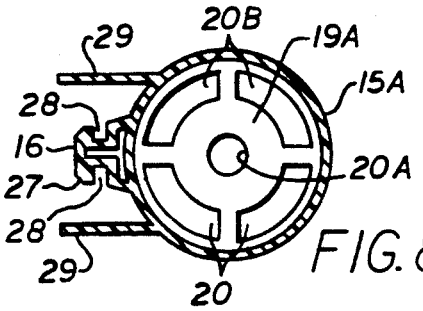
FIG. 8 is a transverse cross section through an alternate embodiment of the baffle plate.

FIG. 8 shows a modification of the coupling 15A wherein the baffle plate 19A has a small central opening 20A and a plurality of circumferentially spaced slots 20B radially outward from the central opening.

The mounting bracket has a curved base portion 30 which conforms generally to the circumference of the air tank T and has a pair of laterally spaced vertical slots 31 formed therein which receive a conventional nylon web belt B having a conventional fastener (not shown) to fasten the bracket to the circumference of the air tank. A hollow, generally square tapered receptacle portion 32 extends outwardly from the base portion 30 and has a central generally square opening 33 in the outer wall. The opening 33 is slightly larger than the periphery of the male extension 16 of the coupling 15. A pair of horizontal slots 34 are formed in the top and bottom walls of the receptacle portion 32.

As best seen in FIG. 7, a fork pin 17 is slidably received through the slots 34 in the bracket receptacle 32. The fork pin 17 has a circular head or ring 35 and a pair of parallel vertical legs 36 extending therefrom. The bottom ends 37 of the legs 36 extend angularly upward and outward, such that when the fork pin 17 is inserted through the horizontal slots 34 the fork pin will be captured in the bracket receptacle, but free to slide up and down. The angular bottom portion 37 of the legs 36 will contact the interior of the top wall 32A of the receptacle 32 to normally prevent the fork pin 17 from being completely removed from the bracket receptacle 32.

The opposed inner surface of the legs 36 are provided with a pair of opposed angular projections 38 which contact a projection 39 on the upper interior of the bracket receptacle 32 to spread them slightly apart as the fork pin 17 is raised relative to e bracket receptacle 32. The opposed inward facing surfaces of the legs 36 are tapered and are disposed adjacent the interior of the square opening 33 in the bracket receptacle 32 (FIG. 5).

The preferred material for the tubing sections 21, 22, end caps 14, 23 and threaded adapter 24 is PVC or ABS plastic because of its light weight and resistance to salt water and corrosion. The preferred material for the coupling 15, bracket 11, and fork pin 17 is nylon because of its high resiliency, low friction, and resistance to salt water and corrosion. The PVC or ABS components and nylon coupling are secured to one another by a suitable bonding agent. The use of nylon material facilitates the resilient and sliding engagement of mating components as described below.

As seen in FIG. 5, 6, and 7, to connect the weight tube 13 to the mounting bracket 11, the weight tube is placed adjacent the bracket receptacle 32 with the male extension 16 aligned with the opening 33 and is pressed against the bracket. As the male extension 16 enters the opening 33, it contacts the legs 36 of the fork pin 17 and the tapered corners 27 of the male extension 16 slide against the tapered surface of the legs 36, spreading them slightly, then allowing them to snap into engagement in the vertical slots 28 of the male extension 16.

Once engaged, the male extension 16 cannot be removed unless the fork pin 17 is raised to engage the opposed angular projections 38 of the legs on the projection 39 on the upper interior of the bracket receptacle 32 to spread them slightly apart sufficient to remove the male extension 16. One end of a conventional emergency release strap or cable (not shown) is connected to the ring 35 of the fork pin 17 and its other end is provided with a D-ring which is conveniently disposed on the front of the existing buoyancy compensator device or back board to which the air tank is attached.

It should be noted, that as the weight tube 13 is pressed against the bracket 11, the rectangular ejector tabs 29 extending outwardly from the coupling 15 at each side of the male extension 16 will engage the tapered side walls 32B of the bracket receptacle 32 and will be urged outwardly as the connection is made. In other words, when the male extension 16 is engaged and retained in the bracket receptacle 32, the ejector tabs 29 are resiliently spring biased against the tapered surfaces 32B of the bracket receptacle 32. Thus, when the fork pin 17 is pulled upward, the resilient tabs 29 tend to resume their parallel orientation and will slide on the tapered surfaces 32 in a spring action to forcefully propel the weight tube away from the bracket. This allows the weight tube 13 to be quickly and efficiently jettisoned in the event of an emergency and insures positive disengagement under all conditions.

Figure 9:
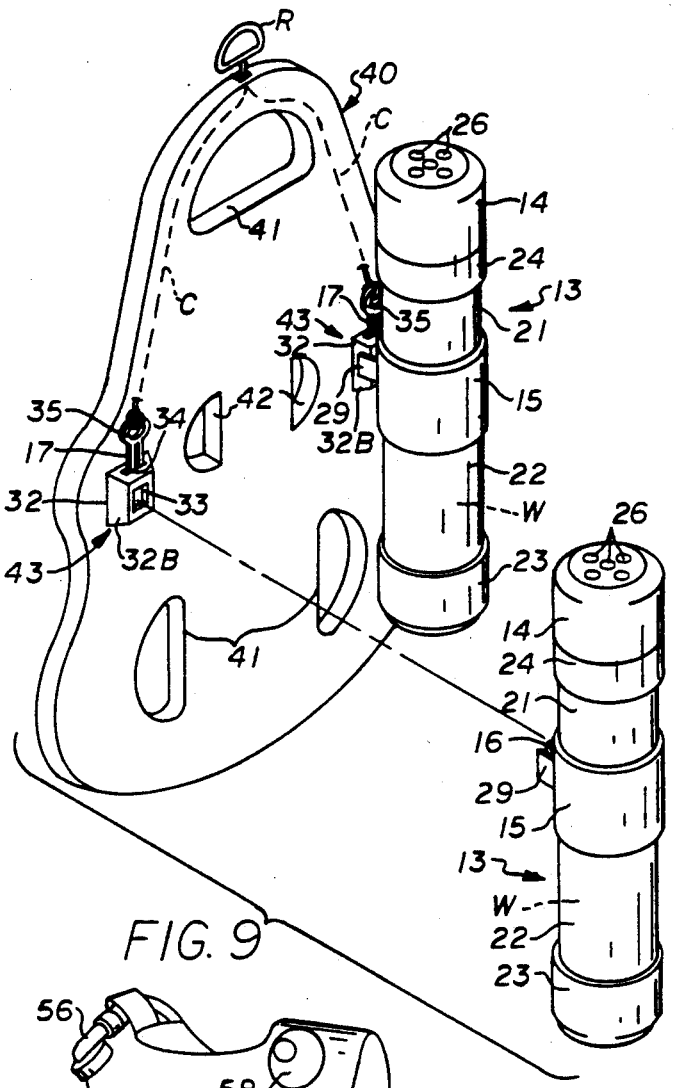
FIG. 9 is an exploded isometric view of a diver's buoyancy compensator back board having a pair of attitude adjusting devices in accordance with the present invention attached thereto.

The attitude adjusting weight tubes may also be incorporated into other scuba diving equipment worn by the diver, such as a buoyancy compensator, backpack, or back board. There is shown in FIG. 9, a diver's back board 40. The back board 40 has apertures 41 which receive straps for fastening the back board to the back of the diver and other apertures 42 which receive straps for fastening an air tank onto the back board.

Laterally spaced mounting brackets 43, similar to that previously described are secured to the back side of the back board 40. Elements of the mounting brackets which have been previously described in detail are assigned the same numerals of reference. The mounting bracket 43 has the same construction as the previously described mounting bracket with the exception of the curved base portion. The mounting brackets 43 are secured to the back board by conventional means depending upon the material used for the back board.

Each mounting bracket 43 has a hollow, generally square tapered receptacle portion 32 extending outwardly from the surface of the back board 40 and has a central generally square opening 33 in the outer wall. The opening 33 is slightly larger than the periphery of the male extension 16 of the coupling 15. A pair of horizontal slots 34 are formed in the top and bottom walls of the receptacle portion 32 and the fork pin 17 is slidably mounted in the bracket receptacle 32, as previously described.

The ends of an emergency release cable C are connected to the ring 35 of the fork pin 17 and its other end is provided with a D-ring R which is conveniently disposed at the top end of the back board 40.

Weight tubes 13 having the previously described quick release coupling 15 and male extension 16 extending laterally outwardly from the circumference of the weight tube intermediate its ends are releasably connected to the mounting brackets 43. The weight tubes 13, coupling 15, and fork pin 17 have been previously described in detail and their detailed description will not be repeated to avoid repetition.

When the weight tubes 13 are pressed against the bracket 43, the rectangular ejector tabs 29 extending outwardly from the coupling 15 at each side of the male extension 16 will engage the tapered side walls 32B of the bracket receptacle 32 and will be urged outwardly as the connection is made. When the D-ring R is pulled, the fork pin 17 is pulled upward and the resilient tabs 29 tend to resume their parallel orientation and will slide on the tapered surfaces 32 in a spring action to forcefully propel the weight tube away from the back board.

Figure 10:
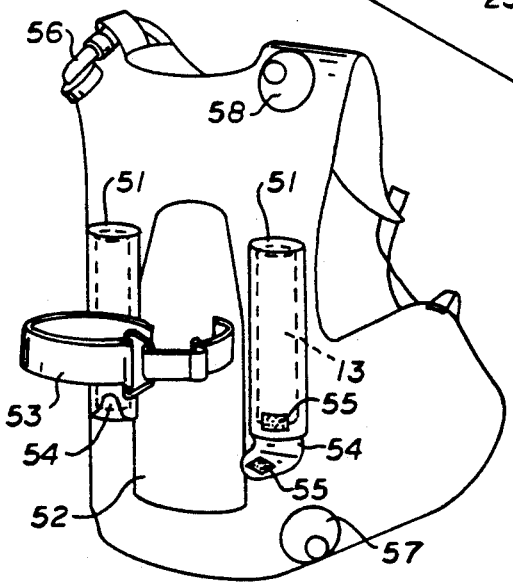
FIG. 10 is a perspective view of a diver's buoyancy compensator vest board having a pair of attitude adjusting devices carried in pockets of the vest.

The attitude adjusting weight tubes may also be carried in pockets on other scuba diving equipment worn by the diver. There is shown in FIG. 10, a diver's inflatable buoyancy compensator vest 50. The buoyancy compensator 50 is provided with pockets 51 on the backside adjacent the back board or tank rack 52 onto which the air tank is secured by belt 53. In this embodiment, the quick release coupling of the weight tubes is eliminated, and the weight tubes 13 are slidably received inside the pockets 51. The pockets 51 have a closure flap 54 at one end and the pocket and flap are provided with a hook and loop type fastener 55 which allow the weight tubes 13 to be quickly released from the pockets in the event of an emergency.

When placed in the pockets 51, the cylindrical weight tubes 13 are releasably carried in close proximity to the torso of the diver in a position with their longitudinal axis generally parallel to the longitudinal axis of the torso of the diver. The free-moving steel balls or shot movably disposed within the interior of the weight tubes are capable of being positioned at varying locations along the length of the weight tubes as the attitude of the diver's body changes in the manner previously described.

The inflatable buoyancy compensator vest 50 includes an internal inflatable bladder (not seen). Conventional fittings 56 on the buoyancy compensator vest allow the bladder to be inflated by the compressed air in the divers tank or from the lungs of the diver. Other conventional fittings 57 allow the bladder to be quickly inflated with gas from a gas cartridge in the event of an emergency, and other fittings 58 on the vest allow the bladder to be connected to a valve to increase or decrease the amount of air in the bladder to adjust the buoyancy of the diver at various swimming depths and relative to the weight of the other equipment worn by the diver.

Figure 11:
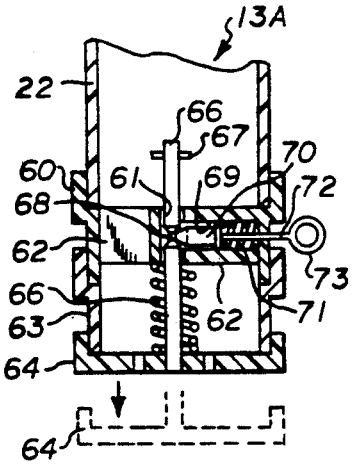
FIG. 11 is a longitudinal cross section through an alternate embodiment of a weight tube having a mechanism at one end for quickly dumping the weights from the tube.

FIG. 11 shows an alternate embodiment of the weight tube 13A wherein the metal balls or shot can be released from the tube. A tubular spider coupling 60 is secured onto the lower section of tubing 22 and is provided with a central bore 61 and radially extending legs 62 which are circumferentially spaced sufficient to allow the balls or shot to pass through. A tubular adapted 63 is secured to the lower end of spider coupling 60 and slidably receives an end cap 64 to enclose the lower end of the tubular structure. A rod 65 extends upwardly from the interior of the end cap 64 and slidably through the bore 61 of the spider coupling 60. A compression spring 66 has one end engaged on the legs 62 of the spider coupling and its other end engaged on the interior of the end cap 64 to normally urge the end cap away from the bottom of the tubular structure. The rod 65 has a stop pin 67 at its upper end to prevent it from being removed from the spider coupling and a reduced diameter portion 68 intermediate its ends.

A bore 69 extends inwardly through one of the legs of the spider coupling and communicates with the bore 61. A plunger 70 is slidably mounted in the bore 69 and is normally urged into engagement with the reduced diameter portion 68 of the rod 65 by a compression spring 71 at its outer end. A small rod 72 extends outwardly from the plunger 70 through the side wall of the spider coupling and has a ring 73 at its outer end for retracting the plunger. One end of an emergency release cable is connected to the ring 73 of the rod 72 and its other end is provided with a D-ring conveniently disposed within easy reach of the diver for retracting the plunger 70.

When the end cap 64 is positioned to enclose the bottom end of the tubular structure, the compression spring 66 is compressed and the plunger 70 is engaged on the reduced diameter portion 68 of the rod 65 to latch the cap 64 in place. In the event of an emergency, the plunger 70 is retracted and the end cap 64 will be urged downward to open the end of the weight tube 13A and allow the balls or shot to be quickly dumped from the tube.

OPERATION

Using the embodiment of FIG. 1 as an example, the mounting bracket with the fork pin 17 inserted is secured to the circumference of the air tank T by the belt B and the air tank is secured to the buoyancy compensator device or tank support back board 40 to be worn by the diver. The buoyancy factor of the diver is determined, and the corresponding quantity of lead balls or shot is placed into the weight tube 13, and the cap 14 is threadedly secured on the top of the weight tube.

The weight tube 13 is then connected to the mounting bracket 11 or 43 by placing the weight tube adjacent the bracket with the male extension 16 of the coupling aligned with the opening 33 of the bracket receptacle 32 and pressing it against the bracket receptacle to snap fit the male extension of the coupling into the receptacle. Care should be taken to see that the ejector tabs 29 have resiliently engaged the tapered side walls 32B of the receptacle and are urged outwardly. The free end of the existing emergency release strap or cable is connected to the ring 35 of the fork pin 17.

After the diver enters the water, and assumes a descending (head-down) attitude, the lead balls or shot will move slowly through the apertured baffle plate 19 to settle in the lowermost front portion of the weight tube (FIG. 2). As the diver levels off to assume a horizontal swimming attitude, the lead balls or shot will slowly become distributed along the entire length of the weight tube (FIG. 3). As the diver assumes an ascending (head-up) attitude, the lead balls or shot will slowly move to the lowermost rear portion of the weight tube. The free moving lead balls or shot slowly and adjustably reposition the weight or ballast automatically as the attitude of the diver changes and will stabilize at the angular position of the diver's body. Movement or the lead balls or shot is facilitated by the vent holes 26 at each end of the weight tube which allow water to circulate through, and drain from, the weight tube.

Thus, the diver does not have to expend energy to overcome permanently placed stationary weights to change attitude in the water and is able to maintain efficient streamlined (fish-like) swimming positions at various attitudes. Consequently, the diver conserves energy and uses less air, allowing more dive time.

In the event of an emergency, the diver can quickly jettison the weight tube(s) by pulling the D-ring of the emergency release cable located on the buoyancy compensator device or back board. When the emergency release cable is pulled, the fork pin 17 is pulled upward and the resilient spring action of the ejector tabs 29 sliding on the tapered surfaces of the bracket receptacle will quickly and forcefully disengage and jettison the weight tube from the bracket.

The attitude adjuster can replace the diver's conventional weight belt and it allows the uncomfortable, poorly positioned ballast (weight belt) to be repositioned from the diver's mid-section to a position over the diver's upper body, the most buoyant area, and permits the weight to slowly shift as the attitude of the diver changes.

While this invention has been described fully and completely with special emphasis upon a preferred embodiment, it should be understood that within the scope of the appended claims the invention may be practiced otherwise than as specifically described herein.

I claim:

1. An attitude adjusting apparatus for use by scuba divers to automatically vary the position of ballast relative to the diver's center of buoyancy as the attitude of their body underwater changes comprising;

an elongate weight receptacle having a longitudinal axis, said weight receptacle adapted to be releasably carried in close proximity to the center of buoyancy of the diver with its longitudinal axis generally parallel to the longitudinal axis of the torso of the diver, and a mass of small independently free-moving weights movably carried by said weight receptacle which are distributed over varying areas along the length thereof relative to the diver's center of buoyancy as the longitudinal axis of the diver's body changes relative to a horizontal axis, said weights comprising means for distributing said weight mass evenly over an area along the length of said weight receptacle at the approximate center of buoyancy when the diver is in a horizontal position, at the forward lowermost portion of said weight receptacle forward of the center of buoyancy as the diver assumes a descending head-down position, and at the rearward lowermost portion of said weight receptacle rearward of the center of buoyancy as the diver assumes an ascending head-up position, and said free-moving weights become stabilized at various areas along the length of said weight receptacle upon the diver maintaining a desired angular swimming position.

2. An attitude adjusting apparatus according to claim 1 including control means on said weight receptacle intermediate its ends for controlling the rate of distribution of said free-moving weights.

3. An attitude adjusting apparatus according to claim 1 in which said weight receptacle is an elongate hollow cylindrical member enclosed at one end and having a removable closure at the opposite end, and fluid passageways in said cylindrical member enclosed end and said removable closure for allowing fluid to circulate through the interior of said cylindrical member to facilitate movement of said free-moving weights underwater and allowing said cylindrical member to drain when removed from the water.

4. An attitude adjusting apparatus according to claim 1 in which said weight receptacle is an elongate hollow cylindrical member, and said mass of small independently free-moving weights are small metal balls, and the total weight of said mass of weights is selectively increased or decreased in small increments by varying the quantity of said metal balls prior to a dive to correspond to the particular buoyancy factor and diving gear worn by the diver.

5. An attitude adjusting apparatus according to claim 4 in which said cylindrical member is enclosed at one end and has a removable closure at the opposite end, and spring biased quick release means on said cylindrical member operatively connected to said removable closure to move it to an open position and allow said mass of weights to be quickly dumped form said cylindrical member in the event of an emergency.

6. An attitude adjusting apparatus according to claim 4 in which the side wall of said cylindrical member has calibrated markings along its length which represent the amount of weight corresponding to the volume of said mass of weights which are placed into said cylindrical member.

7. An attitude adjusting apparatus according to claim 1 including air tank mounting means for connection to the air tank to be worn by the diver and having a releasable connector portion for receiving and releasably connecting at least one said cylindrical member thereto such that its longitudinal axis is generally parallel to the longitudinal axis of the air tank and the torso of the diver, and spring biased quick release means operatively disposed on said connector portion to forcefully propel said cylindrical member away from the air tank and having a release member disposed in easy reach of the diver for quickly disconnecting said cylindrical member from said air tank in the event of an emergency.

8. An attitude adjusting apparatus according to claim 7 including resilient means operatively disposed between said connector portion and said cylindrical member which stores spring energy when said cylindrical member is connected and will release the stored spring energy upon disconnecting said cylindrical member from the air tank to forcefully propel said cylindrical member away from the air tank.

9. An attitude adjusting apparatus according to claim 7 in which said air tank mounting means is a mounting bracket releasably secured to the exterior of the air tank to be worn by the diver and has a female receptacle, said cylindrical member has a male extension portion extending laterally outward from its exterior to be slidably received in said bracket female receptacle and engaged by said quick release means, and said quick release means has a latch portion operatively disposed in said female receptacle to releasably engage said male extension and a pull element connected thereto in easy reach of the diver, whereby said latch portion is quickly disengaged from said male extension and said cylindrical member is quickly disconnected from said air tank in the event of an emergency by the diver pulling said pull element.

10. An attitude adjusting apparatus according to claim 9 in which;

said air tank mounting bracket comprises a curved base portion conforming generally to the circumference of the air tank and having apertures formed therein to receive a mounting strap for securing said bracket to the circumference of the air tank, a hollow generally square tapered receptacle portion extending outwardly from said base portion and having a central generally square opening in its outer wall, a latch member having a ring portion at one end extending outwardly from said receptacle portion and a latch portion closely adjacent said square opening, said cylindrical member has coupling member secured thereto with a male extension portion extending laterally outward from its exterior and configured to be slidably received in said bracket receptacle square opening and releasably engaged by said latch member,and said latch member operatively mounted within said receptacle portion to releasably engage said male extension when pressed into said square opening and to disengage said male extension upon moving said latch member ring portion relative to said bracket receptacle.

11. An attitude adjusting apparatus according to claim 10 in which;

said latch portion disposed closely adjacent said square opening comprises a pair of parallel laterally spaced resiliently expandable members disposed at each side of said square opening, and said male extension is a tapered generally square configuration having slots on opposite sides and a tapered front surface to spread said parallel members as said male extension is received in said square opening and allow said parallel members to snap into engagement in said male extension slots.

12. An attitude adjusting apparatus according to claim 11 in which;

said bracket receptacle has an internal projection to disposed between said latch member parallel members, and said latch member parallel members have laterally opposed angular projections which cooperate with said internal projection when said latch member is raised relative to said bracket receptacle portion to resiliently urge said parallel members apart and disengage them from said male extension slots.

13. An attitude adjusting apparatus according to claim 9 including;

a pair of parallel, generally rectangular resilient ejector tabs spaced laterally one to each side of said male extension extending outwardly from the circumference of said coupling to be slidably received on opposite tapered side walls of said bracket receptacle when said male extension is engaged therein, said ejector tabs being urged outwardly as the connection and resiliently spring biased against the tapered surfaces of said bracket receptacle, such that when said latch member is pulled upward to disengage said male extension said resilient tabs tend to resume their parallel orientation and will slide on the tapered surfaces in a spring action to forcefully propel said cylindrical member away from said mounting bracket.

14. An attitude adjusting apparatus according to claim 4 in which;

said cylindrical member comprises an open-ended tubular coupling, a first section of tubing secured at one end of said coupling and extending axially outwardly therefrom and threaded at the extended end, a second section of tubing secured at the other end of said coupling and extending axially outwardly therefrom and enclosed at the extended end, a cap member threadedly received on the threaded end of said first section of tubing and forming a removable closure for the tubular structure, and fluid passageways in the enclosed end of said second section of tubing and said cap member for allowing fluid to circulate through the interior of said cylindrical member to facilitate movement of said mass of weights underwater and allowing said cylindrical member to drain when removed from the water.

15. An attitude adjusting apparatus according to claim 14 in which said mass of small independently free-moving weights are small metal balls, and including a baffle plate disposed in the interior of said tubular coupling and having at least one passageway therethrough configured to control the passage of said metal balls therethrough such that said metal balls will pass slowly through the mid-section of said cylindrical member as the diver changes his attitude in the water.

16. An attitude adjusting apparatus according to claim 1 including a device worn on the torso of the diver and provided with carrying means for receiving and carrying at least one said cylindrical member thereon, and at least one said cylindrical member received and releasably carried by said device in close proximity to the torso of the diver in a position with its longitudinal axis generally parallel to the longitudinal axis of the torso of the diver.

17. An attitude adjusting apparatus according to claim 16 in which said device worn on the torso of the diver is adapted to receive buoyancy compensating means.

18. An attitude adjusting apparatus according to claim 16 in which said device worn on the torso of the diver is apertured to receive straps for fastening said device to the back of the diver and straps for fastening the air tank onto the device, said carrying means comprises a mounting bracket having a releasable connector portion for receiving and releasably connecting at least one said cylindrical member to said device such that its longitudinal axis is generally parallel to the longitudinal axis of the torso of the diver, quick release means operatively disposed on said bracket connector portion, and a release member on said device disposed in easy reach of the diver and connected to said quick release means for quickly disconnecting said cylindrical member from said device in the event of an emergency.

19. An attitude adjusting apparatus according to claim 18 including resilient means operatively disposed between said connector portion and said cylindrical member which stores spring energy when said cylindrical member is connected and will release the stored spring energy upon disconnecting said cylindrical member to forcefully propel said cylindrical member away from said device.

20. A device worn on the torso of a scuba diver including movable ballast means to vary the position of ballast relative to the diver's center of buoyancy as the attitude of the diver's body underwater changes comprising;

a device worn on the torso of the diver while making a dive and having at least one releasable connector member thereon with quick release means operatively disposed on said connector, at least one weight receptacle having a longitudinal axis received and releasably engaged in said connector on said device in close proximity to the center of buoyancy of the diver with its longitudinal axis generally parallel to the longitudinal axis of the torso of the diver, a release member on said device disposed in easy reach of the diver and connected to said quick release means for quickly disconnecting said weight receptacle from said device in the event of an emergency, resilient means operatively disposed between said connector and said weight receptacle which stores spring energy when said weight receptacle is connected and will release the stored spring energy upon disconnecting said weight receptacle to forcefully propel said weight receptacle away from said device, and free-moving weight means movably carried by said weight receptacle and which are positioned at varying locations along the length thereof as the attitude of the diver's body changes, whereby as the diver assumes a descending head-down position said weight means will move to the forward lowermost portion of said weight receptacle, and as the diver assumes a horizontal position said weight means will be positioned along the length of said weight receptacle, and as the diver assumes an ascending head-up position said weight means will move to the rearward lowermost position of said weight receptacle, and said free-moving weight means become stabilized at various areas along the length of said weight receptacle upon the diver maintaining a desired angular swimming position.

21. A buoyancy compensator and ballast vest for providing buoyancy and adjustably positioned ballast to a diver and automatically varying the position of ballast relative to the diver's center of buoyancy as the attitude of their body underwater changes comprising;

a vest device worn on the torso of the diver and provided with an internal inflatable bladder and means for inflating and deflating the bladder to adjust the buoyancy of the diver at various swimming depths, carrying means on said vest device for receiving and releasably carrying at least one weight receptacle thereon, at least one said weight receptacle having a longitudinal axis received and releasably carried by said vest device in close proximity to the center of buoyancy of the diver in a position with its longitudinal axis generally parallel to the longitudinal axis of the torso of the diver, and a mass of small free-moving weights movably carried by said weight receptacle which are distributed over varying areas along the length thereof relative to the diver's center of buoyancy as the longitudinal axis of the diver's body changes relative to a horizontal axis, said weights comprising means for distributing said weight mass evenly over an area along the length of said weight receptacle at the approximate center of buoyancy when the diver is in a horizontal position, at the forward lowermost portion of said weight receptacle forward of the center of buoyancy as the diver assumes a descending head-down position, and at the rearward lowermost portion of said weight receptacle rearward of the center of buoyancy as the diver assumes an ascending head-up position, and said free-moving weights become stabilized at various areas along the length of said weight receptacle upon the diver maintaining a desired angular swimming position.

* * * * *